US005403660A

United States Patent [19]

Takabatake et al.

[11] Patent Number: 5,403,660

[45] Date of Patent: Apr. 4, 1995

[54] REINFORCING CARBON FIBER AND PROCESS FOR PRODUCING CARBON-CARBON COMPOSITE

[75] Inventors: Minoru Takabatake; Katsumi Takano, both of Touwada, Japan

[73] Assignee: Petoca Ltd., Tokyo, Japan

[21] Appl. No.: 259,141

[22] Filed: Jun. 13, 1994

Related U.S. Application Data

[63] Continuation of Ser. No. 799,229, Nov. 27, 1991, abandoned.

[30] Foreign Application Priority Data

Nov. 30, 1990 [JP] Japan ..... 2-330056

[51] Int. Cl.[6] ..... B32B 9/00; D02G 3/00; D04H 1/58

[52] U.S. Cl. ..... 428/367; 428/288; 428/378; 428/408; 428/902

[58] Field of Search ..... 428/289, 367, 378, 408, 428/902

[56] References Cited

U.S. PATENT DOCUMENTS 4,219,457 8/1980 Taniguchi et al. ..... 523/427
4,420,512 12/1983 Ogawa et al. ..... 523/424
4,654,264 3/1987 Asai et al. ..... 428/367
4,751,258 6/1988 Minami ..... 428/367

FOREIGN PATENT DOCUMENTS 2368571 5/1978 France .
2512474 3/1983 France .
52-52912 4/1977 Japan .
60-127264 7/1985 Japan .
60-127265 7/1985 Japan .

*Primary Examiner*—George F. Lesmes
*Assistant Examiner*—Kathryne E. Shelborne
*Attorney, Agent, or Firm*—Armstrong, Westerman, Hattori, McLeland & Naughton

[57] ABSTRACT

A specific sizing agent comprising as the main component an adduct of mono- or poly-cyclic phenol with alkylene oxide is applied in a specified amount to the surface of a high-strength and high-elasticity carbon fiber or a precursor fiber thereof and then dried to prepare a reinforcing carbon fiber according to the present invention, which is then preformed into a fiber arrangement, impregnated with a precursor of matrix carbon, and carbonized to produce a high-strength and high-elasticity carbon-carbon composite material.

2 Claims, No Drawings

REINFORCING CARBON FIBER AND PROCESS FOR PRODUCING CARBON-CARBON COMPOSITE

This application is a continuation of application Ser. No. 07/799,229, filed Nov. 27, 1991, now abandoned.

BACKGROUND OF THE INVENTION

1. Field of the Invention

The present invention relates to a reinforcing carbon fiber for use in a carbon-carbon composite material obtained by impregnating an aggregation of a carbon as the reinforcing fiber with a liquid carbonizable substance as the precursor of matrix carbon and carbonizing the resulting material, followed by graphitization thereof if necessary. More particularly, the present invention relates to a reinforcing carbon fiber for use in a high-strength carbon-carbon composite material excellent in heat resistance, chemical resistance, etc.

2. Related Art

The interfacial adhesion between the reinforcing carbon fiber and matrix carbon of a carbon-carbon composite material is very poor as compared with those of other composite materials such as carbon fiber-reinforced plastics (CFRP).

A carbon-carbon composite material is produced according to the following procedure. Either a high-strength, high-elasticity carbon fiber still being wound up into a desired morphology, or a carbon fiber structure mainly constituted of a high-strength, high-elasticity carbon fiber to take the form of a woven fabric, a three-dimensional fabric, a non-woven fabric, a unidirectional sheet or the like is impregnated with a thermosetting resin such as a phenolic resin or a furan resin as a precursor of matrix carbon, followed by shaping and curing thereof to form a preliminary carbon-plastic composite material.

The carbon-plastic composite material is carbonized through a heat treatment under an inert atmosphere to obtain a carbonized product in the form of a carbon-carbon composite material or a skelton of a carbon-carbon composite material. If necessary, the densification, or secondary reinforcement, treatment procedure of further impregnating the carbonized product with a thermosetting resin, pitch or the like as the precursor of matrix carbon and subsequently carbonizing the impregnated product is repeated to secure desired properties of the resulting carbon-carbon composite material.

Whether such a secondary reinforcement treatment is necessary or not may be determined together with the number of times of the secondary reinforcement treatment, if necessary, according to the end use application of the final carbon-carbon composite material and the like. In the classical case of using the carbon-carbon composite material as a heat-resistant material or the like, the secondary reinforcement treatment is hardly necessary.

Since a significantly high level of strength has recently been required of carbon-carbon composite materials in a widening variety of fields of applications thereof in addition to the application thereof as heat-resistant materials, however, the necessity of the secondary reinforcement treatment has been increasing accordingly.

The significance of the secondary reinforcement treatment using the precursor of matrix carbon lies in an improvement in the strength of the carbon-carbon composite material by filling carbon into defects ensuing from poor interfacial adhesion between the reinforcing carbon fiber and matrix carbon of the carbon-carbon composite material obtained in the early stage of carbonization, more specifically into separations, cracks or the like along the interfaces between the above-mentioned reinforcing carbon fiber and matrix carbon.

In the case of using a thermosetting resin as the precursor of matrix carbon, the matrix carbon after carbonization is sometimes observed as being separated from the surfaces of the reinforcing carbon fiber to form defects which are usually referred to as separations.

On the other hand, where a pitch matrix type of carbon fiber-reinforced composite material formed through impregnation an aggregation of carbon fiber with pitch is carbonized to produce a carbon-carbon composite material, matrix pitch carbon existing between carbon fibers, though stuck to the surfaces of the fibers, includes therein separation defects formed along the closest extending carbon fiber to the middle of the area of matrix carbon, or crescent defects like something reflective of the velocity gradient profile of a fluid in a state of laminar flow, with the result that the composite material is observed as being poor in the interfacial adhesion between the carbon fiber and the matrix. Such defects are usually referred to as cracks.

A carbon-carbon composite material having such defects as separations or cracks can be improved in physical properties such as mechanical strength in particular by repeating the secondary reinforcement treatment procedure to densify the composite material. Since the secondary reinforcement treatment can only decrease the proportion of existing defects, however, the defects present along the extending, reinforcing carbon fiber resisting stress put on the carbon-carbon composite material cannot essentially be obviated.

Pitch which may be either of coal origin or of petroleum origin is predominantly used as the precursor material of matrix carbon for the secondary reinforcement treatment therewith in an economical aspect and from the viewpoint of the yield of carbon through carbonization.

Pitch forms a mesophase exhibiting extreme anisotropy in terms of optical texture in the course of heat treatment thereof. The texture of carbon formed from pitch also shows extreme anisotropy like graphitic material.

Consequently, the secondary reinforcing material formed through the above-mentioned secondary reinforcement treatment to fill up the neighborhoods of the reinforcing carbon fibers provides carbon of graphitic texture showing optical anisotropy, and, hence, includes therein laminar defects innate as in most of graphitic carbon materials. This entails a problem yet to be solved in improving the shear strength of the carbon-carbon composite material though the above-mentioned matrix pitch carbon can fulfill the role of carbonaceous filling material.

In order to improve the interfacial adhesion of a reinforcing carbon fiber to the matrix carbon of a carbon-carbon composite material, it is a common practice to use a surface-treated type of reinforcing carbon fiber having the surface thereof subjected to an oxidation treatment such as an electrolytic oxidation treatment to introduce thereinto functional groups in a similar way to that in the case of production of plastic composite materials.

This can not only definitely improve the adhesion of the reinforcing carbon fiber to the precursor of matrix carbon but also increase the interfacial adhesion in some local sites between the reinforcing carbon fiber and the matrix carbon even after carbonization, but this localized, increased interfacial adhesion is so strong that separations and cracks are caused in the other weakly adherent interfacial sites in keeping with great shrinkage of the precursor of matrix carbon during carbonization.

When an object of the carbon-carbon composite material is small in size, the apparently small amount of shrinkage of the object during carbonization can keep the morphology of the object intact. On the other hand, when an object of the carbon-carbon composite material is large in size, defects are quite often formed during carbonization. Particularly when the object is a laminate of carbon fiber fabrics, fatal interfacial delamination and cracking are brought about during the course of carbonization. Thus, the use of the surface-treated type of reinforcing carbon fiber cannot be said to be preferable.

Japanese Patent Laid-Open No. 52,912/1977 discloses the use of the same kind of precursor of matrix carbon as the starting material of reinforcing carbon fiber, in which case the matrix carbon formed through carbonization of the precursor thereof shows substantially the same properties as the reinforcing carbon fiber. This enables a difference therebetween in thermal expansion coefficient to be minimized, with the result that a heat treatment, if necessary, in a high-temperature range can be effected with a decrease in defects such as cracks and separations formed around the interfaces between the reinforcing carbon fiber and the matrix carbon. In this sense, the foregoing technology is effective to some extent.

Since the shrinkage of the precursor of matrix carbon is large in the early phase of the carbonization, however, defects are liable to be formed around interfaces between the reinforcing carbon fiber and the matrix carbon being formed. In this sense, that technology still involves a problem yet to be solved.

Japanese Patent Laid-Open Nos. 127,264/1985 and 127,265/1985 disclose the use of carbon fibers having the surfaces thereof coated with a phenolic resin or a pitch-modified phenolic resin by kneading the two materials together, as the reinforcing material of a carbon-carbon composite material.

The disclosed technologies are effective in production of a short fiber-reinforced type of carbon-carbon composite materials, but generally inapplicable to production of a filament-reinforced type of high-strength carbon-carbon composite materials. Furthermore, since the coating material is also bound to serve as the precursor of matrix carbon, however, the problem with the difference in shrinkage between the reinforcing carbon fibers and the matrix carbon in the early phase of the carbonization, which difference is particularly problematic in the interfacial portions of both materials, is yet to be solved.

The use of a sizing or coupling agent such as a silane compound or an epoxy compound, which is commonly applied to glass fibers and the like as reinforcing materials generally for reinforced plastics, may be conceived of with the aim of improving the interfacial adhesion between the reinforcing carbon fiber and matrix carbon of a carbon-carbon composite material. However, this is not desirable because the use of an epoxy sizing agent does not improve the interfacial adhesion between the reinforcing carbon fiber and matrix carbon of a final composite material because of its poor affinity for the precursor of matrix carbon and of its low yield of carbon by carbonization, while the use of a coupling agent such as a silane compound, if still present in the final heat treatment step, causes a decrease in the strength of the resulting carbon-carbon composite material, leading to a necessity of removing the coupling agent before the final heat treatment step.

SUMMARY OF THE INVENTION

The present invention has been completed based on the following finding. An adequate and desirable interfacial adhesion can be realized between the reinforcing carbon fiber and matrix carbon of a carbon-carbon composite material by coating beforehand the reinforcing carbon fiber with a medium capable of fulfilling an interfacer-like role without any substantial adverse effect such as a decrease in the strength of a final carbon-carbon composite material even if the medium remains after carbonization. In other words, a novel specific sizing agent is applied to the reinforcing carbon fiber prior to the production therefrom of the carbon-carbon composite material to attain good interfacial adhesion between the carbon fiber and matrix carbon thereof.

Specifically, in accordance with one aspect of the present invention, there is provided a reinforcing carbon fiber for use in a high-strength carbon-carbon composite material, comprising:

- a precursor fiber capable of turning into a high-strength and high-elasticity carbon fiber, or a high-strength and high-elasticity carbon fiber; and
- a dry coating adhering to the surface of the above-mentioned precursor fiber or carbon fiber and derived from 0.3 to 10.0% by dry weight, based on the precursor fiber or carbon fiber, of a specific sizing agent comprising as the main component an adduct of mono- or poly-cyclic phenol with alkylene oxide.

In a preferred embodiment of the present invention, the sizing agent has been applied directly to the surface of the precursor fiber of high-strength and high-elasticity carbon fiber without any preliminary surface treatment thereof, followed by drying thereof.

In accordance with another aspect of the present invention, there is provided a process for producing a high-strength and high-elasticity carbon-carbon composite material, comprising the steps of:

- coating the surface of a precursor fiber capable of turning into high-strength and high-elasticity carbon fiber, or a high-strength and high-elasticity carbon fiber with 0.3 to 10.0% by dry weight, based on the precursor fiber or carbon fiber, of a specific sizing agent comprising as the main component an adduct of mono- or poly-cyclic phenol with alkylene oxide, followed by drying thereof;
- preforming the coated precursor fiber or carbon fiber into a fiber arrangement, or fiber structure, corresponding to a carbon-carbon composite material;
- impregnating the fiber arrangement, or fiber structure, with a precursor of matrix carbon;
- carbonizing the impregnated fiber arrangement, or fiber structure, to form the carbon-carbon composite material.

In a preferred embodiment of the process of the present invention, the sizing agent is applied directly to the precursor fiber of high-strength and high-elasticity carbon fiber without any preliminary surface treatment thereof, followed by drying thereof.

The present invention will now be specifically described in more detail.

A. (Precursor) of Carbon Fiber

In the reinforcing carbon fiber of the present invention, a high-strength and high-elasticity carbon fiber or a precursor fiber capable of turning into a high-strength and high-elasticity carbon fiber is used as the major component. It is to be noted that the reinforcing carbon fiber of the present invention encompasses the above-mentioned precursor fiber coated with the specific sizing agent as well.

The kind of precursor fiber capable of turning into a high-strength and high-elasticity carbon fiber (hereinafter referred to simply as "precursor fiber") to be used in the present invention is not particularly restricted. When consideration is given to the physical properties of the final product, however, the precursor fiber is desired to gain a high strength and a high modulus of elasticity through carbonization and graphitization thereof for production of a carbon-carbon composite material.

Specifically, a carbon fiber prepared from petroleum or coal pitch fiber as the starting material, and particularly a precursor fiber, prepared by customary infusiblization and subsequent (slight) carbonization treatments of a pitch fiber formed through customary melt-spinning of a pitch containing optically anisotropic components or having an easy convertibility into an optically anisotropic pitch by the action of stress or heat, are preferable to a carbon fiber prepared from a PAN (acrylonitrile) synthetic fiber as the starting material.

The term "precursor fiber" used herein is usually intended to indicate a fiber having a tensile strength of 100 to 250 kgf/mm$^2$ and a tensile modulus of elasticity of $10\times10^3$ to $50\times10^3$ kgf/mm$^2$ and being capable of increasing at least 1.1-fold in both tensile strength and tensile modulus of elasticity through posterior carbonization and graphitization thereof to have a tensile strength of at least 250 kgf/mm$^2$ and a tensile modulus of elasticity of at least 50x103 kgf/mm$^2$ The term "high-strength and high-elasticity carbon fiber" used herein is intended to indicate a carbon fiber obtained by carbonization and graphitization treatments of the above-mentioned precursor fiber or by direct carbonization and graphitization treatments of an infusiblized fiber and having a tensile strength of at least 250 kgf/mm$^2$ and a tensile modulus of elasticity of at least $50\times10^3$ kgf/mm$^2$.

More specifically, the precursor fiber is prepared according to the following continuous or batch-wise treatment procedure:

(a) Formation of Pitch Fiber

A pitch fiber can be easily formed from a pitch source as mentioned above by a customary spinning method such as a spun-bonding method, a melt spinning method or a centrifugal spinning method. The melt spinning method, in which a pitch fiber spun from a spinneret is wound up continuously at a high speed, is preferred from the viewpoint of quality.

(b) Preparation of Infusiblized Fiber

The above-mentioned pitch fiber is infusiblized in an oxidizing atmosphere at relatively low temperatures including a maximum temperature of 200° to 400° C. according to a customary method to obtain an infusiblized fiber. This treatment is preventive of interfiber fusion.

(c) Slight Carbonization

The above-mentioned infusiblized fiber is slightly carbonized by heating in an inert atmosphere at a heat-up rate of 10° to 100° C./min up to a temperature of at most 2,000° C., preferably 500° to 1,500° C., to obtain a precursor fiber as defined in the present invention.

B. Treatment with Sizing Agent

In the present invention, the surface of the above-mentioned precursor fiber or carbon fiber is coated with a sizing agent dissimilar to conventional ones, followed by drying thereof. The amount of the sizing agent applied, or adhered, to the precursor fiber or carbon fiber must be within the range as specified in the present invention.

(a) Chemical Structure of Main Component of Sizing Agent

The adduct of mono- or poly-cyclic phenol with alkylene oxide to be used as the main component of the sizing agent in the present invention is a mono- or poly-cyclic aromatic compound represented by the following general formula [I]or [II]:

$$A_n-X-O-Y-H \quad [I]$$

[II]

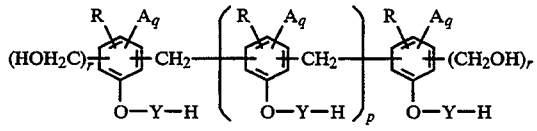

wherein A is a benzyl, styryl or α-methylstyryl group; X is an unsubstituted or substituted aromatic hydrocarbon group; Y is an oxyalkylene group containing an alkylene group having 2 or 3 carbon atoms; R is a hydrogen atom or an alkyl group having 1 to 9 carbon atoms; n is an integer of 0 to 5; p is an integer of 0 to 9; q is an integer of 0 to 2; and r is an integer of 0 to 2.

The mono- or poly-cyclic aromatic compound of the formula [I] that may be used in the present invention is an adduct of unsubstituted or substituted aromatic mono-ol with alkylene oxide, or an adduct of aralkyl-substituted aromatic mono-ol with alkylene oxide wherein the aralkyl is selected from benzyl, styryl, and α-methylstyryl.

Examples of the unsubstituted aromatic mono-ol include phenol and naphthol, while examples of the substituted aromatic mono-ol include o-phenylphenol, p-phenylphenol, cumylphenols, and cresols.

Specific examples of the mono- or poly-cyclic aromatic compound of the formula [I] include an adduct of monobenzylated o-phenylphenol with ethylene oxide (1 mole), an adduct of tribenzylated phenol with ethylene oxide (2 moles), an adduct of monobenzylated o-, m- or p-phenylphenol with ethylene oxide (3 moles), an adduct of tribenzylated m-phenylphenol with ethylene oxide (5 moles), an adduct of benzylated o-phenylphenol with propylene oxide (4 moles), an adduct of tristyrylated cumylphenol with ethylene oxide (5 moles), and an adduct of distyrylated m-phenylphenol with propylene oxide (4 moles), which may be arbitrarily used either alone or in mixture.

The polycyclic aromatic compound of the formula [II] that may be used in the present invention is an adduct of novolak resin with alkylene oxide, wherein the novolak resin is prepared from an unsubstituted or substituted phenol and formaldehyde.

The novolak resin is prepared by an addition condensation reaction of the unsubstituted or substituted phenol with formaldehyde in an acidic reaction system. The resulting condensate novolak resin is usually an oligomer having 2 to 11 monomer units.

Specific examples of the polycyclic aromatic compound of the formula [II] include an adduct of phenolic novolak resin with ethylene oxide, an adduct of phenolic novolak resin with propylene oxide, an adduct of cresolic novolak resin with ethylene oxide, an adduct of cresolic novolak resin with propylene oxide, an adduct of phenolic novolak resin with mixture of ethylene oxide and propylene oxide, an adduct of cresolic novolak resin with mixture of ethylene oxide and propylene oxide, an adduct of styrylated phenol-formaldehyde condensate with ethylene oxide, an adduct of styrylated cresol-formaldehyde condensate with propylene oxide, an adduct of benzylated phenol-formaldehyde condensate with ethylene oxide, and an adduct of benzylated phenol-formaldehyde condensate with propylene oxide, which may be arbitrarily used either alone or in mixture.

Further, the mono- or poly-cyclic aromatic compounds of the formula [I] and the polycyclic aromatic compounds of the formula [II] may be used either alone or in mixture.

The amount of the alkylene oxide added to the mono- or poly-cyclic phenol in the aromatic compound of the formulae [I] or [II] is preferably in the range of 1 to 10 moles per mole of phenolic hydroxyl groups, more preferably in the range of 2 to 6 moles per mole of phenolic hydroxyl groups.

A polycyclic aromatic compound represented by the formula [I] is prepared, for example, by reacting phenol or phenylphenol with benzyl chloride, styrene or $\alpha$-methylstyrene in the presence of a Lewis acid catalyst and addition-reacting the resulting product with an alkylene oxide in the presence of potassium hydroxide catalyst according to a customary method.

A polycyclic aromatic compound represented by the formula [II] is prepared, for example, by reacting phenol or cresol, benzylated phenol, styrylated phenol, nonylphenol or the like with formaldehyde in the presence of an acid catalyst and addition-reacting the resulting product with an alkylene oxide in the presence of potassium hydroxide catalyst according to a customary method.

(b) Application and Drying of Sizing Agent

The sizing agent comprising as the main component an adduct of mono- or poly-cyclic phenol with alkylene oxide according to the present invention is applied on the surface of the precursor fiber of reinforcing carbon fiber or the reinforcing carbon fiber according to a customary method, followed by drying.

The application of the sizing agent may be done by a known application method such as dip coating, roller coating, or spray coating. Dip coating is preferable from the viewpoint of the simplicity of operation and the relative uniformity of coating film.

The term "drying " used herein indicates removal of water, a solvent, etc. at a low temperature (generally in the mild-temperature range of ordinary temperatures to about 100° C.) without denaturation as well as curing of the sizing agent.

Denaturation of the sizing agent is undesirable because its function of an interfacer is spoiled.

(c) State of Sizing Agent at the Time of Application

The sizing agent comprising as the main component an adduct of mono- or poly-cyclic phenol with alkylene oxide according to the present invention may be used in the form of a solution diluted with a solvent or an aqueous emulsion. From the industrial point of view, however, an aqueous emulsion is preferred.

The use of an emulsifier is necessary to prepare an aqueous emulsion. Examples of the emulsifier include alkylphenyl (e.g., nonylphenyl, octylphenyl, and dodecylphenyl) propylene oxides, and polycyclic aromatic hydrocarbon (e.g., styrylated phenyl, benzylphenyl, cumylphenyl, and benzylated cumylphenyl) propylene oxides, to each molecule of which a plurality of ethylene oxide molecules may further be added with the aim of enhancing the emulsion-stabilizing action of the emulsifier.

The blending proportion of the emulsifier to the main component of the sizing agent is preferably at most 30 wt. %.

The foregoing sizing agent comprising as the main component an adduct of mono- or poly-cyclic phenol with alkylene oxide is applied and adhered to the surface of the precursor fiber of reinforcing carbon fiber or the reinforcing carbon fiber in such a proportion that the amount of the solid residue of the effective components, the main component and the emulsifier, contained in the sizing agent is 0.3 to 10.0 wt. % based on the precursor fiber or the carbon fiber.

(d) Amount of Sizing Agent after Drying

The amount of the sizing agent comprising as the main 10 component an adduct of mono- or poly-cyclic phenol with alkylene oxide is in the range of 0.3 to 10.0% by dry weight as mentioned above, preferably 1.0 to 5.0% by dry weight, based on the precursor fiber of reinforcing carbon fiber or the reinforcing carbon fiber. The amount of the sizing agent is generally increased in the case of short fibers as compared with the case of filament fibers.

When the amount of the sizing agent is too large in the case of filament fibers, the resultant brittleness of the filament fibers coated with the sizing agent is unfavorably liable to bring about breakage of the fibers during the course of processing for production of a carbon fiber fabric, though production of a unidirectional sheet or a laminate thereof is possible. Further, in this case, filament separation of fiber bundles is disadvantageously deteriorated to decrease the proportion of impregnant matrix carbon to carbon fiber in the resulting composite material.

On the other hand, when the amount of the sizing agent is smaller than 0.3% by dry weight based on the fiber, the application of the sizing agent is unavoidably uneven to lessen the desired effect of the present invention.

When the amount of the sizing agent is 0.3 to 10.0% by dry weight based on the fiber in accordance with the present invention, the fiber (precursor fiber or carbon fiber) coated with the sizing agent shows an adequate capability of being bundled, while causing no grave trouble in a later fabrication step, such as a weaving step, of preforming a fiber arrangement corresponding to a composite material.

The application of the sizing agent improves the wettability of the precursor fiber of reinforcing carbon fibers or the reinforcing carbon fiber with a precursor of matrix carbon such as pitch or a thermosetting resin, examples of which include a phenolic resin and a furan resin. This wettability is very important in production of a carbon-carbon composite material, for which the reinforcing carbon fiber of the present invention is used.

C. Preforming of Fiber Arrangement

The reinforcing carbon fiber coated with the sizing agent, after dried, is formed into a fiber arrangement, or fiber structure, corresponding to a carbon-carbon composite material in accordance with the application or use thereof. Examples of such a fiber arrangement, or fiber structure, include a woven fabric, a three-dimensional woven fabric, and a unidirectional sheet.

Modes of fabrication for forming the fiber arrangement include weaving, laminating and a variety of shaping.

D. Impregnation with Precursor of Matrix Carbon

The fiber arrangement of reinforcing carbon fiber is impregnated with a precursor of matrix carbon.

Examples of the precursor of matrix carbon include thermosetting resins such as a phenolic resin and a furan resin, and a variety of pitch either of petroleum origin or of coal origin, capable of gaining optical anisotropy through later heat treatment and carbonization.

E. Heat Treatment

The precursor-impregnated fiber arrangement is subjected to a heat treatment (carbonization, graphitization, etc.) to have the interfaces between the reinforcing fiber and matrix carbon thereof turned into a favorable state.

The heat treatment is effected, for example, in an inert atmosphere at a high temperature of 1,500° to 2,500° C.

If the resulting product, carbon-carbon composite material, is further subjected to a secondary reinforcement treatment involving impregnation thereof with the same kind of precursor of matrix carbon as used in the first impregnation operation and to a further heat treatment, the carbon-carbon composite material is more densified to have the interfaces between the reinforcing fiber and matrix carbon turned into a better state. The resulting carbon-carbon composite material has excellent folding endurance and interlayer shear strength.

F. Surface Treatment

In the present invention, the precursor fiber of reinforcing carbon fiber or the reinforcing carbon fiber may be subjected to a customary surface treatment such as electrolytic oxidation or vapor phase oxidation to introduce thereinto functional groups prior to the application of the sizing agent, according to the prior art technology.

In the case of the precursor fiber, however, the surface treatment renders the interfacial adhesion between the fiber and the matrix carbon, may be too strong. Therefore, the precursor fiber is preferably coated directly with the sizing agent without the surface treatment thereof.

In the case of a carbon fiber heat-treated at a high temperature, the preliminary surface treatment thereof is preferably effected prior to the application thereonto of the sizing agent from the viewpoint of providing a carbon-carbon composite material having a high strength and a high modulus of elasticity.

Without the surface treatment and without the application of the sizing agent, the above-mentioned carbon fiber heat-treated at a high temperature provides a carbon-carbon composite material poor in flexural properties in terms of strength and modulus of elasticity. By contrast, the application of the sizing agent on the carbon fiber in accordance with the present invention improves the strength and modulus of elasticity of a final carbon-carbon composite material.

With the surface treatment but without the application of the sizing agent, the above-mentioned carbon fiber provides a carbon-carbon composite material having a measure of modulus of elasticity but a poor strength, which can, however, be improved by the application of the sizing agent in accordance with the present invention.

In view of the above, the best results can be obtained when the carbon fiber heat-treated at a high temperature is preliminarily subjected to the surface treatment and to the application of the sizing agent.

G. High-Strength Carbon-Carbon Composite Material

The carbon-carbon composite material produced in accordance with the process of the present invention, when, for example, in the following forms, exhibits excellent mechanical properties as mentioned below on the basis of conversion on the assumption that the volume fiber content, which is the volume content of the carbon fiber in the composite material, is 60%.

1) flexural strength in the case of a unidirectionally reinforced carbon-carbon composite material: at least 85 kgf/mm$^2$
2) flexural strength in the case of a bidirectionally reinforced carbon-carbon composite material in the form of a laminate of carbon fiber woven fabrics (by plain weave, satin weave, or the like): at least 30 kgf/mm$^2$ The dry solid residue of the sizing agent applied onto the surface of a reinforcing carbon fiber or a precursor fiber thereof for a carbon-carbon composite material according to the present invention comprises an adduct of mono- or poly-cyclic phenol with alkylene oxide. The mono- or poly-cyclic aromatic moiety of the adduct has an affinity for the surface of the reinforcing carbon fiber or the precursor fiber thereof, while the alkylene oxide moiety of the adduct has an affinity for a thermosetting resin or the like as the precursor of matrix carbon. Thus, the adduct can play the role of an interfacer existing in the interfaces between the fiber and the matrix.

The above-mentioned specific sizing agent used in the present invention, even if allowed to remain after carbonization, does not adversely affect the interfacial state between the carbon fiber and matrix carbon of the carbon-carbon composite material because the main component of the sizing agent is quite similar in chemical structure to the precursor of matrix carbon.

The affinities, as the interfacer, of the sizing agent applied directly onto the precursor fiber without the surface treatment thereof are weaker than a strong chemical bond believed to be created between the surface of the surface-treated carbon fiber and the precursor of matrix carbon. This can prevent material defects such as cracks or separations from being induced by sizable shrinkage of the precursor of matrix carbon during carbonization.

The affinity of the above-mentioned interfacer for the precursor of matrix carbon may be strong because of the probable reactivity of the alkylene oxide moiety of the adduct with the precursor of matrix carbon.

The carbon-carbon composite material produced using the reinforcing carbon fiber of the present invention has such a favorable interfacial state that an adequate adhesion is realized between the reinforcing carbon fiber and matrix carbon of the carbon-carbon composite material. This makes the folding endurance and interlayer shear strength of the composite material excellent.

BEST MODES FOR CARRYING OUT THE INVENTION

The following Examples will now more specifically illustrate the present invention, but should not be construed as limiting the scope of the invention.

SYNTHESIS EXAMPLE 1

(Synthesis of Polycyclic Aromatic Compound A)

170 g (1.0 mole) of o-phenylphenol and 0.40 g of zinc chloride as a catalyst were placed in a flask and heated up to 110° C. Subsequently, 379.5 g (3.0 moles) of benzyl chloride was drop-wise added to the mixture at 110° to 125° C. over a period of 3 hours. After hydrogen chloride gas formed was removed from the reaction system, 0.5 g of potassium hydroxide was added to the reaction system. The reaction mixture was transferred into an autoclave, wherein the reaction product was then addition-reacted with 2.0 moles of ethylene oxide at 130° to 140° C. according to a customary method, followed by neutralization of the remaining catalyst. Thus, adduct of tribenzylated phenylphenol with ethylene oxide (2 moles) [Polycyclic Aromatic Compound A] was obtained.

Example 1

A bundle of petroleum pitch type carbon fiber not subjected to any surface treatment (tensile strength: 240 kgf/mm$^2$ tensile modulus of elasticity: $20\times10^3$ kgf/mm$^2$, fiber diameter: 10.1 μm, the number of filaments: 2,000) was coated, by dip coating, with each of aqueous emulsion type sizing agents comprising as the main component the adduct of tribenzylated o-phenylphenol with ethylene oxide (2 moles) obtained in Synthesis Example 1 and respectively having varied effective component concentrations, followed by drying thereof.

Each of the resulting carbon fiber bundles differing in the dry base amount of the sizing agent adhered to the fiber was formed into an 8-harness satin fabric to observe the weaving processability of the fiber bundle and the appearance of the resulting fabric.

Also, the same carbon fiber bundles were dipped in a phenolic resin (Plyophen TD-2254: manufactured by Dainippon Ink and Chemicals, Inc.) for 30 minutes and the separabilities of the carbon fiber filaments were then observed.

The results are shown in Table 1.

It will be understood from Table 1 that the suitable amount of the sizing agent is in the range of 0.3 to 10.0% by dry weight, preferably 1.0 to 5.0% by dry weight, based on the fiber bundle.

The same results as in the foregoing Example 1 were obtained in the case of using a sizing agent comprising as the main component other adducts of polycyclic phenol with alkylene oxide.

TABLE 1

(Amount of Sizing Agent vs. Weaving Processability, Appearance of Fabric and Filament Separability after Dipping in Phenolic Resin)

| Amount of Sizing Agent | Weaving Processability | Appearance of Fabric | Filament Separability |
|---|---|---|---|
| 0.1 wt. % | x | very fuzzy | ◎ |
| 0.3 wt. % | Δ | slightly fuzzy | ◎ |
| 0.5 wt. % | ∘ | slightly fuzzy | ∘ |

TABLE 1-continued (Amount of Sizing Agent vs. Weaving Processability, Appearance of Fabric and Filament Separability after Dipping in Phenolic Resin)

| Amount of Sizing Agent | Weaving Processability | Appearance of Fabric | Filament Separability |
|---|---|---|---|
| 1.0 wt. % | ◎ | good | ∘ |
| 3.0 wt. % | ◎ | good | ∘ |
| 5.0 wt. % | ◎ | good | ∘ |
| 7.0 wt. % | ∘ | good | Δ |
| 10.0 wt. % | Δ | slightly hard | Δ |
| 12.0 wt. % | x | some bundles broken | x |
| 15.0 wt. % | x | some bundles broken | x |

Note)
Weaving Processability:
◎ good, ∘ possible Δ possible but poor, x impossible
Filament Separability:
◎ very good, ∘ good Δ slightly poor but acceptable x poor

Example 2

The same bundle of petroleum pitch type carbon fiber as used in Example 1 was coated with a sizing agent comprising as the main component adduct of monobenzylated o-phenylphenol with ethylene oxide (2 moles), followed by drying thereof. The-amount of the sizing agent was 2.0% by dry weight based on the fiber bundle. The resulting bundle of coated carbon fiber as the reinforcing material was formed into a unidirectionally reinforced carbon-carbon composite material according to the following procedure.

The bundle of coated carbon fiber was dipped in a phenolic resin (Plyophen TD-2254: manufactured by Dainippon Ink and Chemicals, Inc.), and then wound around a mandrel while arranging the fiber filaments in a substantially single direction, followed by curing at 120° C. for 2 hours. After removal of the mandrel, the resulting cylindrical product was cut to an adequate size, and then subjected to a carbonization treatment in an atmosphere of nitrogen gas under atmospheric pressure up to a temperature of 1,200° C.

The resulting carbonized product was impregnated with molten petroleum pitch (softening point: 131° C., yield of carbon by carbonization: 54 wt. %) under a reduced pressure of 20 to 40 mmHg for deaeration thereof. After purging with argon gas, the pressure was increased to 10 kg/cm$^2$ to continue the impregnation under an increased pressure. The impregnated product was carbonized in an atmosphere of argon gas under an increased pressure of 100 kg/cm$^2$ by heating at a heat-up rate of 2.5° C./min up to 650° C., and further carbonized in an atmosphere of nitrogen gas under ordinary pressure by heating up to 1,200° C. The forgoing impregnation and carbonization procedure was repeated twice under the same conditions to densify the product. Thereafter, the densified product was further carbonized in an atmosphere of argon gas under ordinary pressure at 2,000° C.

The resulting carbon-carbon composite material exhibited excellent folding endurance and interlayer shear strength. The results are shown in Table 2.

Comparative Example 1

A unidirectionally reinforced carbon-carbon composite material was formed in substantially the same manner as in Example 2 except that the same bundle of petroleum type carbon fiber as used in Examples 1 and 2 was coated with an epoxy type sizing agent in an amount of 1.5% by dry weight based on the fiber bundle to prepare a reinforcing material.

The folding endurance and interlayer shear strength of the composite material were inferior to those of the composite material of Example 2. The results are shown in Table 2.

Example 3

The same bundle of petroleum pitch type carbon fiber as used in Example 1 and 2 was coated with a sizing agent comprising as the main component adduct of tristyrylated cumylphenol with ethylene oxide (5 moles), followed by drying thereof. The amount of the sizing agent was 3.2% by dry weight based on the fiber bundle. The resulting bundle of coated carbon fiber was dipped in a furan resin (Hitafuran 302: manufactured by Hitachi Chemical Co., Ltd.). The bundle of coated carbon fiber was wound around a mandrel while arranging the fiber filaments in a substantially single direction, followed by curing at 80° C. for 2 hours. Thereafter, a unidirectionally reinforced carbon-carbon composite material was formed in the same manner as in Example 2.

The properties of the resulting carbon-carbon composite material were shown in Table 2. The composite material exhibited excellent folding endurance and interlayer shear strength like the composite material of Example 2.

Comparative Example 2

Using the same reinforcing material as prepared in Comparative Example 1, a unidirectionally reinforced carbon-carbon composite material was formed in substantially the same manner as in Example 3.

The folding endurance and interlayer shear strength of the composite material were poorer than the composite material of Example 2 like in Comparative Example 1. The results are shown in Table 2.

TABLE 2

(Properties of Unidirectionally Reinforced Carbon—Carbon Composite Material)

| | Ex. 2 | Ex. 3 | Comp. Ex. 1 | Comp. Ex. 2 |
|---|---|---|---|---|
| Volume Carbon Fiber Content (%) | 52 | 54 | 53 | 54 |
| Bulk Density ($g/cm^3$) | 1.90 | 1.90 | 1.91 | 1.90 |
| Flexural Strength ($kgf/mm^2$) | 92.0 | 95.2 | 68.5 | 72.0 |
| Flexural Modulus of Elasticity ($\times 10$ $kgf/mm^2$) | 25.0 | 25.7 | 19.0 | 22.3 |
| Interlayer Shear Strength ($kgf/mm^2$) | 3.10 | 2.85 | 2.00 | 1.95 |

Example 4

An 8-harness satin fabric constituted of the same reinforcing material as used in Example 2 was each cut into an about 20 cm square, and then impregnated with the same furan resin as used in Example 3 to form cloth sheets, which were then laminated on each other, followed by curing. The cured product was carbonized in an atmosphere of nitrogen gas up to 650° C., while being pressed under a surface pressure of about 100 $kg/cm^2$. It was then further carbonized in an atmosphere of nitrogen gas under ordinary pressure up to 1,200° C.

The carbonized product was impregnated again with the same petroleum pitch as used in Example 2, heated in an atmosphere of nitrogen gas under ordinary pressure at a heat-up rate of 20° C./hour up to 600° C., kept at that temperature for one hour, heated at a heat-up rate of 150° C./hour up to 1,200° C., and then kept at that temperature for one hour. The foregoing densification procedure was repeated three times.

The resulting densified product was further carbonized in an atmosphere of argon gas under ordinary pressure by heating up to 2,000° C.

The properties of the resulting carbon-carbon composite material are shown in Table 3.

Comparative Example 3

Using the same reinforcing material used in Comparative Example 1, a carbon-carbon composite material was produced in the same manner as in Example 4.

The properties of the carbon-carbon composite material were poorer than those of the composite material of Example 4. The results are shown in Table 3.

TABLE 3

(Properties of Carbon—Carbon Composite Material in the Form of Cloth Sheet Laminate)

| | Ex. 3 | Comp. Ex. 3 |
|---|---|---|
| Volume Carbon Fiber Content (%) | 63 | 68 |
| Bulk Density ($g/cm^3$) | 1.84 | 1.89 |
| Flexural Strength ($kgf/mm^2$) | 34.5 | 22.0 |
| Flexural Modulus of Elasticity ($\times 10^3$ $kgf/mm^2$) | 10.2 | 8.8 |
| Interlayer Shear Strength ($kgf/mm^2$) | 1.55 | 1.05 |

Example 5

An carbon-carbon composite material was produced using a carbon fiber (trade name "HM-70" manufactured by Petoca Ltd., tensile strength: 320 $kgf/mm^2$, modulus of elasticity: $71\times 10^3$ $kgf/mm^2$) in the same manner as in Example 2.

In the above-mentioned composite material, the influences of application of a sizing agent as well as a surface treatment by electrolytic oxidation were examined. The results are shown in Table 4.

TABLE 4

| Surface Treatment | not done | | done | |
|---|---|---|---|---|
| Application of Sizing Agent | not done | done | not done | done |
| Volume Carbon Fiber Content (%) | 51 | 53 | 53 | 54 |
| Bulk Density ($g/cm^3$) | 1.87 | 1.89 | 1.90 | 1.91 |
| Flexural Strength ($kgf/mm^2$) | 45.4 | 47.8 | 65.5 | 83.5 |
| Flexural Modulus of Elasticity ($\times 10^3$ $kgf/mm^2$) | 24.7 | 37.3 | 36.3 | 39.9 |
| Interlayer Shear Strength ($kgf/mm^2$) | 1.47 | 2.09 | 1.85 | 2.85 |

(Carbonization Temperature: 2,000° C.)

According to the present invention, the use of a novel specific sizing agent in accordance with present invention remarkably improves the interfacial adhesion between the reinforcing carbon fiber and matrix carbon of composite material to materialize a high-strength carbon-carbon composite material having excellent folding endurance and interlayer shear strength.

What is claimed is:

1. A reinforcing carbon fiber for use in a carbon-carbon composite comprising:

a precursor fiber convertible into a pitch type carbon fiber or a pitch type carbon fiber; and a dry coating adhering to the surface of said precursor fiber or said pitch type carbon fiber and derived from 0.3 to 10.0% by dry weight, based on said precursor fiber or pitch type carbon fiber, of a specific sizing agent consisting essentially of a phenolic compound selected from the group consisting of compounds represented by the following formulae (I) and (II):

$$An-X-O-Y-H \quad (I)$$

(II)

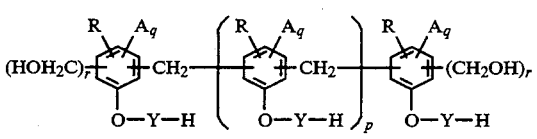

wherein

A is a benzyl, styryl, or α-methylstyryl group,

X is an unsubstituted or substituted aromatic hydrocarbon group,

Y is a polyoxyalkylene group having 2 to 6 mols of an alkylene oxide having 2 or 3 carbon atoms added;

R is a hydrogen atom or an alkyl group having 1 to 9 carbon atoms, n is an integer of 0 to 5, p is an integer of 0 to 9, q is an integer of 0 to 2, and r is an integer of 0 to 2.

2. A reinforcing carbon fiber for use in a carbon-carbon composite comprising:

a precursor fiber convertible into a pitch type carbon fiber without any preliminary surface treatment thereof, or a pitch type carbon fiber; and a dry coating adhering to the surface of said precursor fiber directly or said pitch type carbon fiber and derived from 0.3 to 10.0% by dry weight, based on said precursor fiber or pitch type carbon fiber, or a specific sizing agent consisting essentially of a phenolic compound selected from the group consisting of compounds represented by the following formulae (I) and (II):

$$An-X-O-Y-H \quad (I)$$

(II)

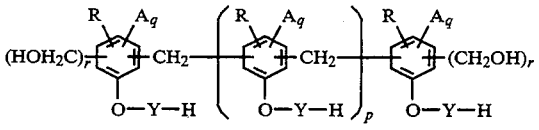

wherein

A is a benzyl, styryl, or α-methylstyryl group,

X is an unsubstituted or substituted aromatic hydrocarbon group,

Y is polyoxyalkylene group having 2 to 6 mols of an alkylene oxide having 2 or 3 carbon atoms added;

R is a hydrogen atom or an alkyl group having 1 to 9 carbon atoms, n is an integer of 0 to 5, p is an integer of 0 to 9, q is an integer of 0 to 2, and r is an integer of 0 to 2.

* * * * *